US012624877B2

(12) United States Patent
Ryu et al.

(10) Patent No.: US 12,624,877 B2
(45) Date of Patent: May 12, 2026

(54) CLIMATE REGULATING FEATURES FOR A REFRIGERATOR ICEBOX

(71) Applicant: Haier US Appliance Solutions, Inc., Wilmington, DE (US)

(72) Inventors: Choonjae Ryu, Prospect, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 40 days.

(21) Appl. No.: 18/596,178

(22) Filed: Mar. 5, 2024

(65) Prior Publication Data

US 2025/0283645 A1 Sep. 11, 2025

(51) Int. Cl.
*F25C 1/04* (2018.01)
*F25C 5/182* (2018.01)

(52) U.S. Cl.
CPC ..... *F25C 1/04* (2013.01); *F25C 5/182* (2013.01)

(58) Field of Classification Search
CPC .... F25C 1/04; F25C 5/182; F25C 5/22; F25D 23/04
See application file for complete search history.

(56) References Cited

U.S. PATENT DOCUMENTS 5,297,394 A 3/1994 Frohbieter et al.
8,720,221 B2 5/2014 Anselmino et al.
11,859,893 B2 * 1/2024 Jeong ..... F25C 1/24
2010/0257877 A1 * 10/2010 Yun ..... F25D 17/065 62/340
2010/0262295 A1 * 10/2010 Lee ..... F25C 5/22 700/275
2022/0282901 A1 9/2022 Cho et al.

FOREIGN PATENT DOCUMENTS

CN 1648563 A * 8/2005 ..... F25D 17/045
CN 102226617 A * 10/2011
CN 112739968 A * 4/2021 ..... F25C 1/24
EP 3443280 B1 4/2022
KR 100584270 B1 5/2006
KR 20170100756 A * 9/2017 ..... F25D 23/028

* cited by examiner

*Primary Examiner* — Kun Kai Ma
(74) *Attorney, Agent, or Firm* — Dority & Manning, P.A.

(57) ABSTRACT

An ice making assembly mounted on a door of a refrigerator appliance includes an icebox mounted on the door and defining an ice making chamber and an icebox opening to the ice making chamber, an ice storage bin positioned below the icebox for storing ice, wherein an intake slot is defined between the icebox and the ice storage bin, a damper mounted over the icebox opening and being movable between an open position to permit a flow of air through the icebox opening and a closed position to prevent the flow of air through the icebox opening, a drive motor operably coupled to the damper, and a controller in operative communication with the drive motor for selectively pivoting the damper between the open position and the closed position.

20 Claims, 5 Drawing Sheets

CLIMATE REGULATING FEATURES FOR A REFRIGERATOR ICEBOX

FIELD OF THE INVENTION

The present subject matter relates generally to refrigerator appliances, and more particularly to door-mounted icemakers for refrigerator appliances.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

It may be desirable to place craft icemakers on the freezer door for forming craft ice cubes (e.g., such as balls of ice greater than 2 inches in diameter), which are typically large cubes made by a conventional twist tray icemaker. Ideally, such an icemaker reliably produces high quality ice if the ambient temperature is maintained at a temperature elevated relative to the typical freezer compartment in which the icebox is located. Maintaining temperatures above this level may produce high-quality cubes with no cracks or surface bumps. In addition, these cubes may be easy to release from the icemaker mold. However, due to their positioning within the freezer compartment, door-mounted craft icemakers are typically maintained at too low a temperature, resulting in poor ice quality, poor harvest reliability, and consumer dissatisfaction. In addition, these compartments may prevent warm air from escaping, resulting in trapped humidity inside the compartment when water is added.

Accordingly, a refrigerator appliance with features for improved ice making would be desirable. More particularly, a refrigerator appliance with a door-mounted craft icemaker that is maintained at a temperature and humidity to produce high quality craft ice would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a refrigerator appliance defining a vertical direction, a lateral direction, and a transverse direction is provided, including a cabinet defining a chilled chamber, a door being rotatably mounted to the cabinet to provide selective access to the chilled chamber, an icebox mounted on the door and defining an ice making chamber and an icebox opening to the ice making chamber, and a damper mounted over the icebox opening and being movable between an open position to permit a flow of air through the icebox opening and a closed position to prevent the flow of air through the icebox opening.

In another exemplary embodiment, an ice making assembly mounted on a door of a refrigerator appliance is provided. The ice making assembly includes an icebox mounted on the door and defining an ice making chamber and an icebox opening to the ice making chamber, an ice storage bin positioned below the icebox for storing ice, wherein an intake slot is defined between the icebox and the ice storage bin, a damper mounted over the icebox opening and being movable between an open position to permit a flow of air through the icebox opening and a closed position to prevent the flow of air through the icebox opening, a drive motor operably coupled to the damper, and a controller in operative communication with the drive motor for selectively pivoting the damper between the open position and the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
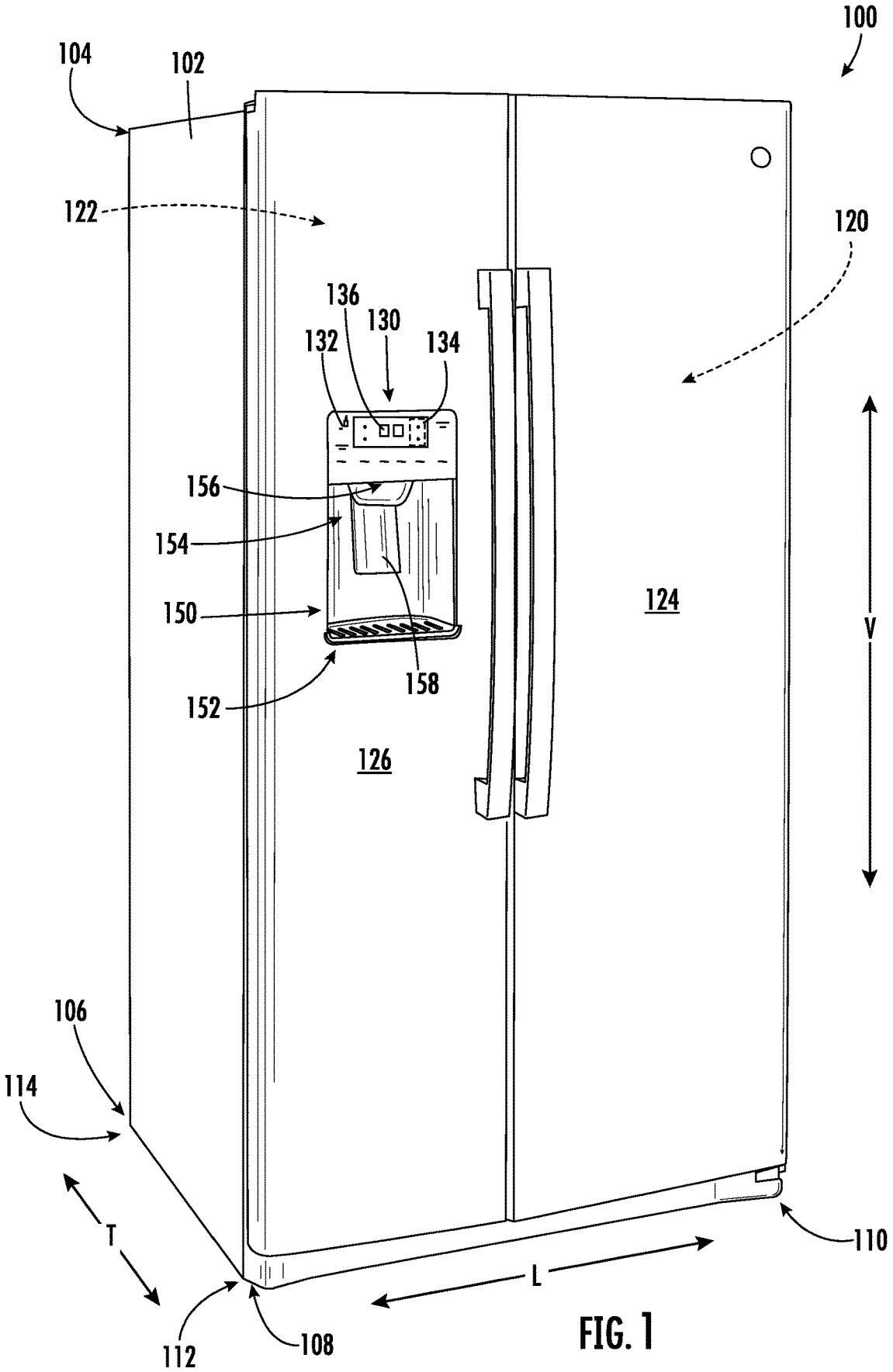
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 120 positioned at or adjacent second side 110 of housing 102 and a freezer chamber 122 arranged at or adjacent first side 108 of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance. Consequently, the description set forth herein is for illustrative purposes only and is not intended to be limiting in any aspect to any particular refrigerator chamber configuration.

A refrigerator door 124 is rotatably hinged to an edge of housing 102 for selectively accessing fresh food chamber 120. In addition, a freezer door 126 is rotatably hinged to an edge of housing 102 for selectively accessing freezer chamber 122. Refrigerator door 124 and freezer door 126 are shown in the closed configuration in FIG. 1. One skilled in the art will appreciate that other chamber and door configurations are possible and within the scope of the present invention.

A control panel 130 is provided for controlling the mode of operation. For example, control panel 130 includes one or more selector inputs 132, such as knobs, buttons, touch-screen interfaces, etc., such as a water dispensing button and an ice-dispensing button, for selecting a desired mode of operation such as crushed or non-crushed ice. In addition, inputs 132 may be used to specify a fill volume or method of operating dispensing assembly 150. In this regard, inputs 132 may be in communication with a processing device or controller 134. Signals generated in controller 134 operate refrigerator appliance 100 and dispensing assembly 150 in response to selector inputs 132. Additionally, a display 136, such as an indicator light or a screen, may be provided on control panel 130. Display 136 may be in communication with controller 134 and may display information in response to signals from controller 134.

As used herein, "processing device" or "controller" may refer to one or more microprocessors or semiconductor devices and is not restricted necessarily to a single element. The processing device can be programmed to operate refrigerator appliance 100 and dispensing assembly 150. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Figure 2:
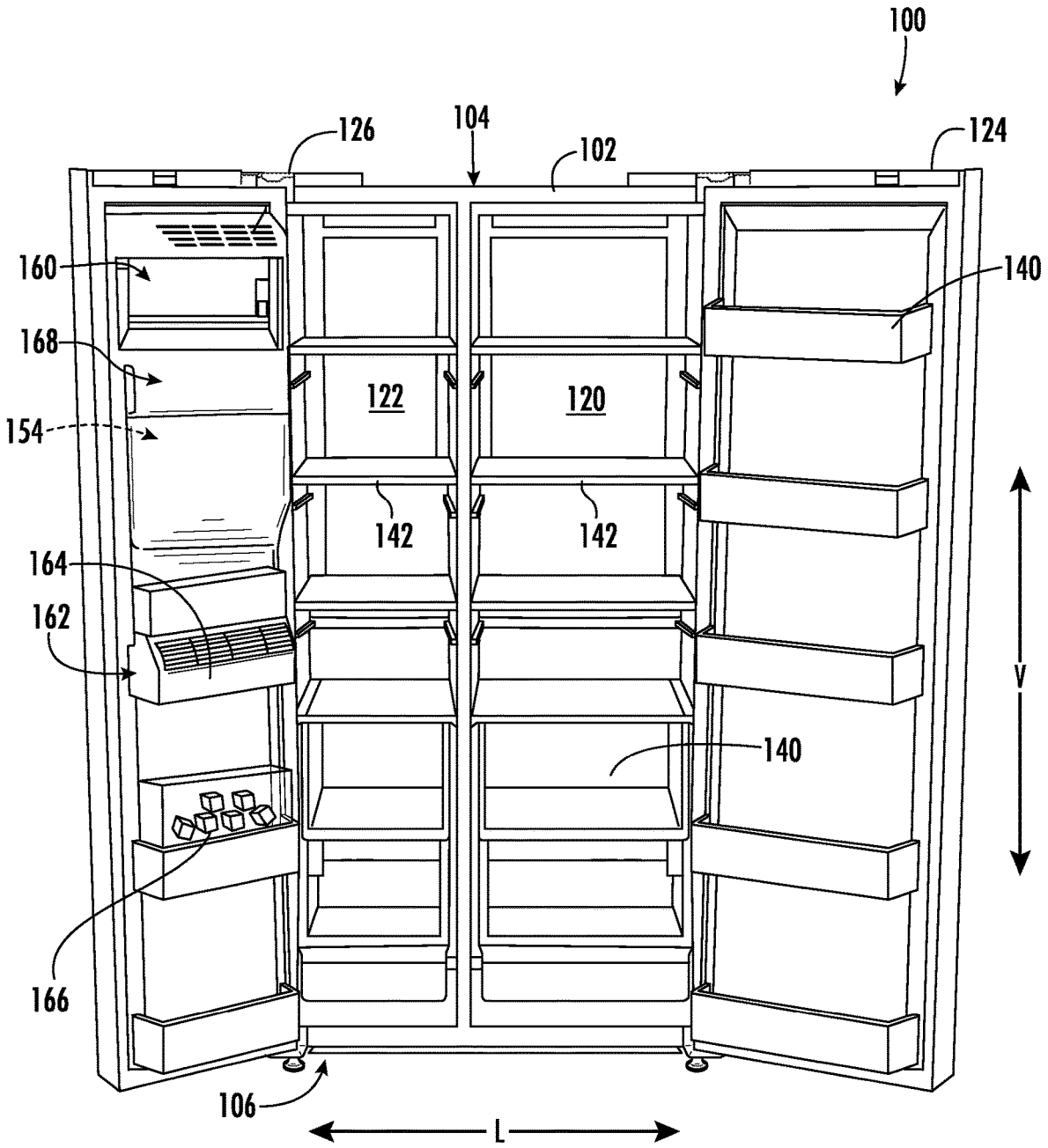
FIG. 2 provides a perspective view of the exemplary refrigerator appliance of FIG. 1, with the doors of the fresh food chamber and freezer chamber shown in an open position.
Figure 3:
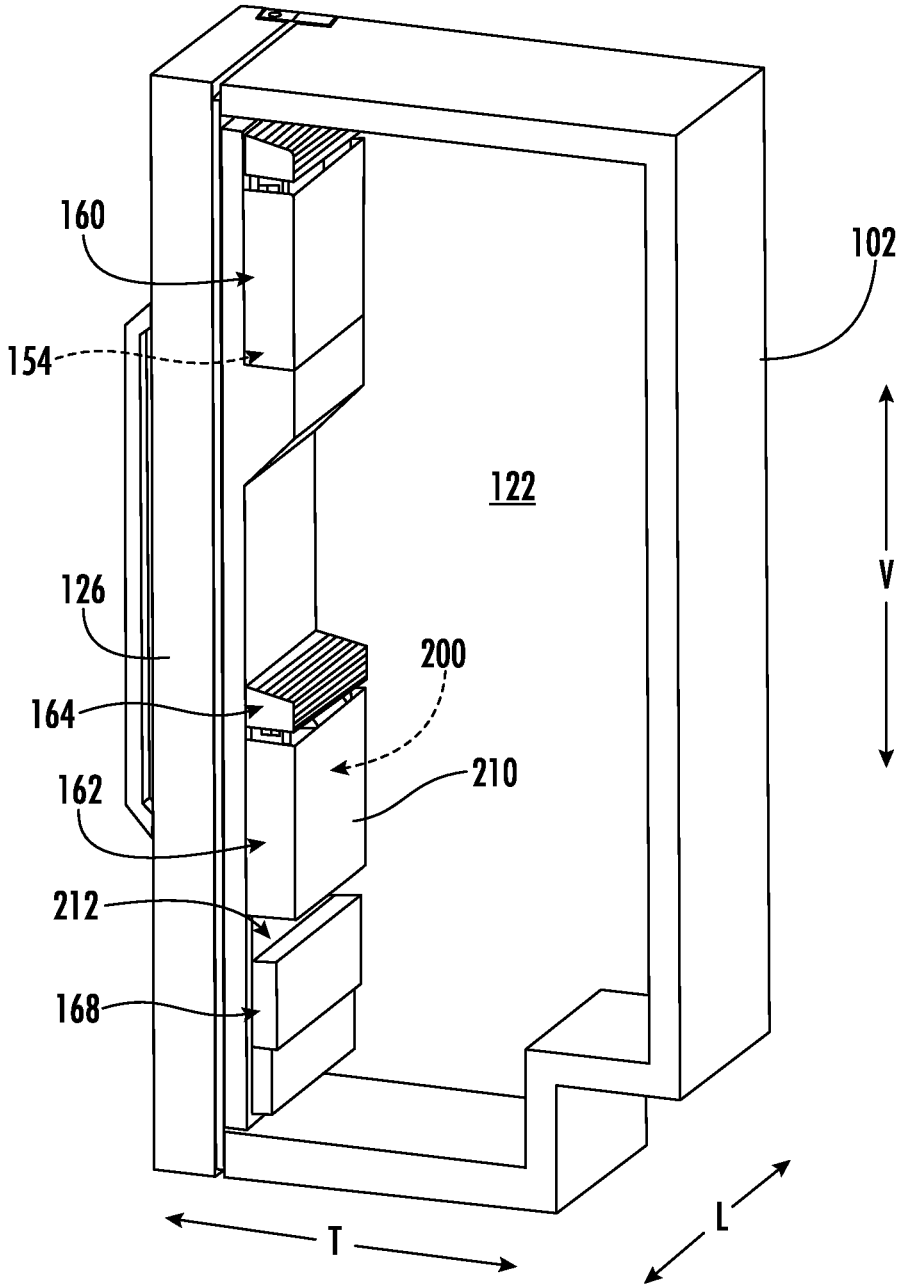
FIG. 3 provides a side cross-sectional view of an icebox and ice making assembly for use with the exemplary refrigerator appliance of FIG. 1 according to an exemplary embodiment of the present subject matter.

FIG. 2 provides a perspective view of refrigerator appliance 100 shown with refrigerator door 124 and freezer door 126 in the open position. As shown in FIG. 2, various storage components are mounted within fresh food chamber 120 to facilitate storage of food items therein as will be understood by those skilled in the art. In particular, the storage components may include bins 140 and shelves 142. Each of these storage components are configured for receipt of food items (e.g., beverages and/or solid food items) and may assist with organizing such food items. As illustrated, bins 140 may be mounted on refrigerator door 124 and freezer door 126 or may slide into a receiving space in fresh food chamber 120 or freezer chamber 122. It should be appreciated that the illustrated storage components are used only for the purpose of explanation and that other storage components may be used and may have different sizes, shapes, and configurations.

Referring now generally to FIGS. 1 and 2, a dispensing assembly 150 will be described according to exemplary embodiments of the present subject matter. Dispensing assembly 150 is generally configured for dispensing liquid water and/or ice. Although an exemplary dispensing assembly 150 is illustrated and described herein, it should be appreciated that variations and modifications may be made to dispensing assembly 150 while remaining within the present subject matter.

Dispensing assembly 150 and its various components may be positioned at least in part within a dispenser recess 152 defined on freezer door 126. In this regard, dispenser recess 152 is defined on a front side 112 of refrigerator appliance 100 such that a user may operate dispensing assembly 150 without opening freezer door 126. In addition, dispenser recess 152 is positioned at a predetermined elevation convenient for a user to access ice and enabling the user to access ice without the need to bend over. In the exemplary embodiment, dispenser recess 152 is positioned at a level that approximates the chest level of a user.

Dispensing assembly 150 includes an ice dispenser 154 including a discharging outlet 156 for discharging ice from dispensing assembly 150. An actuating mechanism 158, shown as a paddle, is mounted below discharging outlet 156 for operating ice or water dispenser 154. In alternative exemplary embodiments, any suitable actuating mechanism may be used to operate ice dispenser 154. For example, ice dispenser 154 can include a sensor (such as an ultrasonic sensor) or a button rather than the paddle. Discharging outlet 156 and actuating mechanism 158 are an external part of ice dispenser 154 and are mounted in dispenser recess 152.

As shown in FIG. 2, inside refrigerator appliance 100, freezer door 126 may house one or more icemakers and ice storage bins that are configured forming and storing ice, respectively. In this regard, for example, freezer door 126 may include a first icebox 160 that includes an ice making chamber for housing ice making assemblies, storage mechanisms, and/or dispensing mechanisms. For example, first icebox 160 may be positioned proximate a top of freezer door 126 and may be designed for dispensing standard ice, e.g., through a front of freezer door 126 via dispensing assembly 150.

Figure 4:
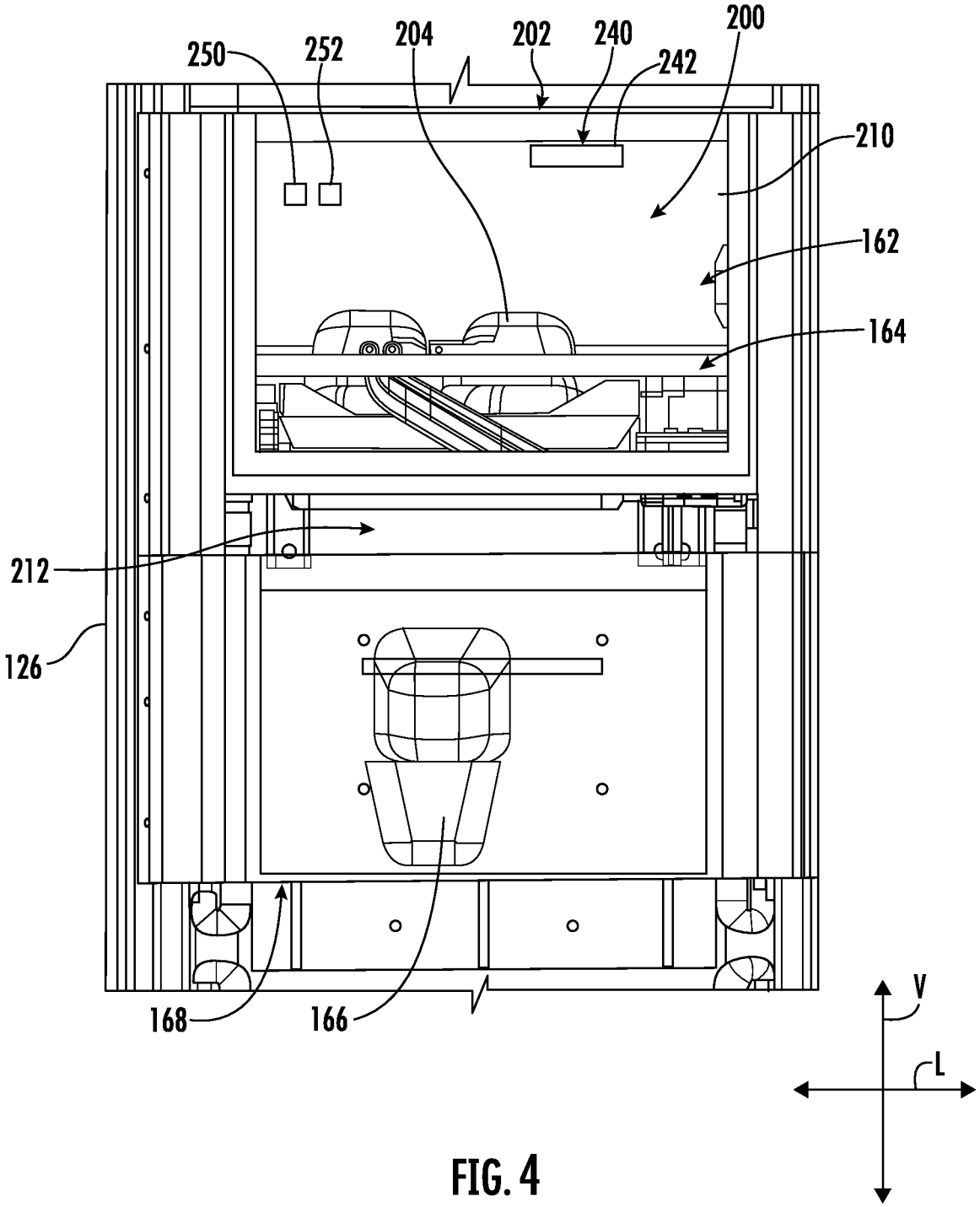
FIG. 4 provides a front view of an icebox and ice making assembly for use with the exemplary refrigerator appliance of FIG. 1 according to an exemplary embodiment of the present subject matter.
Figure 5:
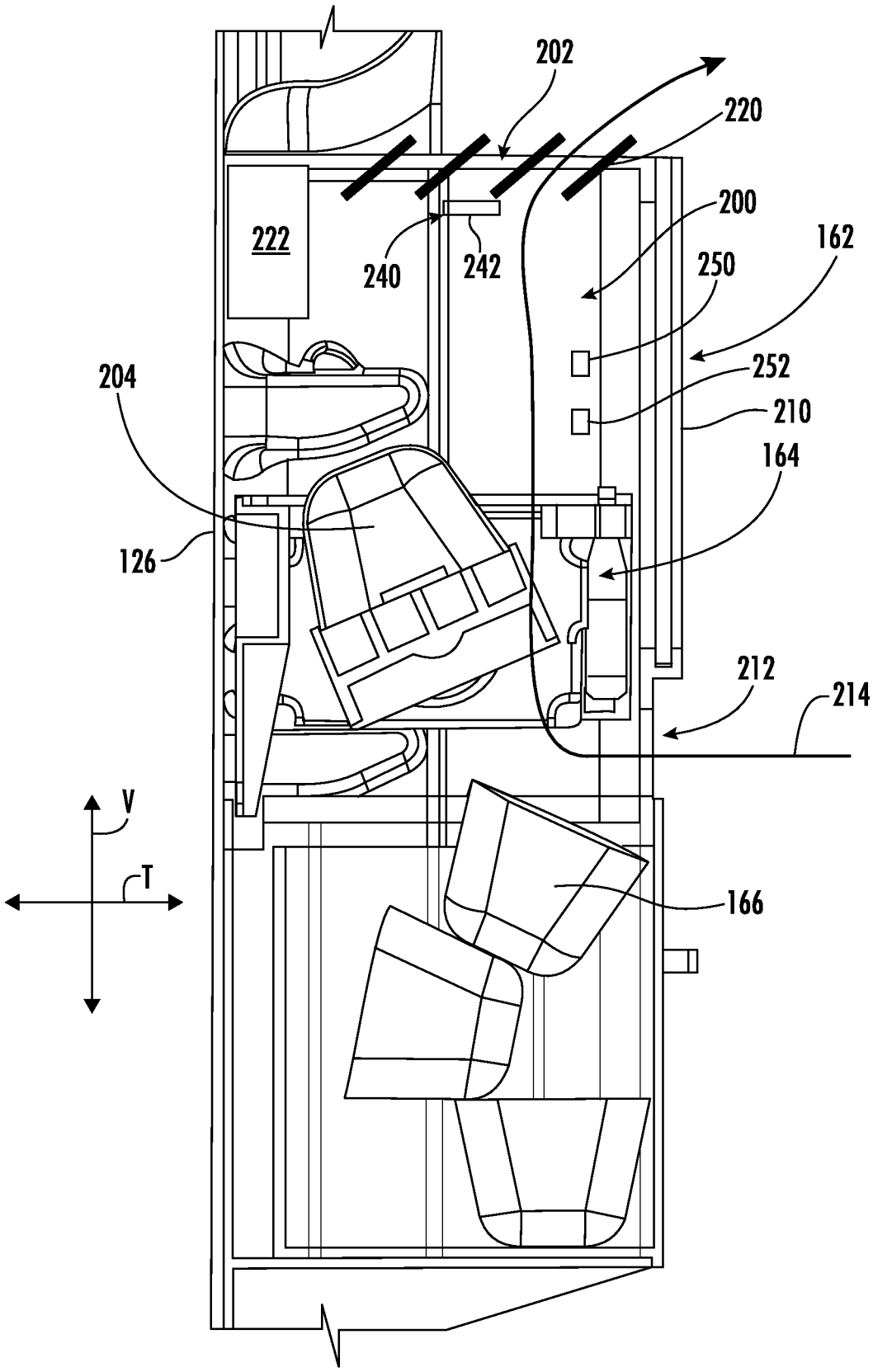
FIG. 5 provides a side view of an icebox and ice making assembly for use with the exemplary refrigerator appliance of FIG. 1 according to an exemplary embodiment of the present subject matter.

In addition, according to an example embodiment of the present subject matter, freezer door 126 may also include a second icebox 162 that may house an ice making assembly 164 that operates independently of the icemaker in first icebox 160. For example, ice making assembly 164 may be a craft icemaker for forming "craft ice" that is commonly large, clear cubes or spheres of ice for alcoholic or non-alcoholic drinks (e.g., as identified generally by reference numeral 166 in FIGS. 4 and 5). A storage bin 168 may be positioned below icemaker for storing formed ice. A user may access this craft ice by opening freezer door 126 and accessing storage bin 168 directly.

Notably, the formation of craft ice may generally be improved if the ice formation temperature is elevated relative to conventional freezer temperatures. For example, conventional freezer temperatures hover around 0° F., whereas desired temperature for forming craft ice of high quality may be between about 15° F. and 20° F. Accordingly, aspects of the present subject matter generally directed to features of ice making assembly 164 and second icebox 162 that facilitate increased icebox temperatures and improved ice formation.

Notably, sealing off second icebox 162 may be desirable for maintaining suitable temperatures for forming craft ice. However, certain conditions may occur where warm, humid air inside second icebox 162 is unable to escape, e.g., when ice making assembly 164 is filled with water. If the humidity within second icebox 162 is unable to escape, frost may have a tendency to form on the inner walls of freezer door 126 and on ice making assembly 164. This frost may build up over time and affect the operation of the icemaker when 164 and the ice formation process.

Referring now specifically to FIGS. 2 through 5, ice making assembly 164 will be described in more detail according to example embodiments of the present subject matter. Specifically, according to the illustrated embodiment, the second icebox 162 may be mounted on freezer door 126 of refrigerator appliance 100 and may define an ice making chamber 200 and an icebox opening 202 to ice making chamber 200. In general, ice making assembly 164 may be positioned within second icebox 162 where the temperature and humidity may be carefully regulated for forming high quality ice that may be easily removed from an ice mold 204 of ice making assembly 164.

Specifically, according to the illustrated embodiment, second icebox 162 may be formed from a plurality of solid icebox walls 210. In general, icebox walls 210 may include a front wall, a rear wall, two lateral sidewalls, and a top wall, each of which may be insulated. Icebox walls 210 generally define ice making chamber 200. In addition, according to the illustrated embodiment, ice storage bin 168 may be positioned below second icebox 162 for storing ice 166. According to the illustrated embodiment, an intake slot 212 may be defined between the ice storage bin 168 and a bottom of second icebox 162 along the vertical direction V. Intake slot 212 may generally be sized and configured for drawing in cool air (e.g., as identified generally by reference numeral 214) to reduce the temperature within ice making chamber 200.

In addition, icebox opening 202 may be defined in a top icebox wall 210 of second icebox 162. In this manner, as warmer air rises, cool air 214 may be drawn in through intake slot 212 and may pass upward along the vertical direction V through ice making chamber 200 before exiting icebox opening 202. According to example embodiments of the present subject matter, ice making assembly 164 may further include a damper 220 mounted over icebox opening 202 for regulating the flow of cool air 214. In this regard, damper 220 may be movable between an open position to permit the flow of cool air 214 through icebox opening 202 and a closed position to prevent the flow of cool air 214 through icebox opening 202. According to the illustrated embodiment, damper 220 includes a plurality of louvers that are pivotally mounted to top icebox wall 210. However, it should be appreciated that according to alternative embodiments, any other suitable damper 220 or flow regulating device may be used while remaining within the scope of the present subject matter.

As illustrated, ice making assembly 164 may include a drive motor 222 that is operably coupled to damper 220. Controller 134 may be in operative communication with drive motor 22 for selectively pivoting damper 220 between the open and closed position. Accordingly, controller 134 may regulate the position of damper 220 to control the temperature within ice making chamber 200. In addition, as described in more detail below, damper 220 may be regulated to control the humidity within ice making chamber 200.

According to an example embodiment, controller 134 may be configured to open damper 220 during the first portion of an ice making process and close damper 220 during a second, subsequent portion of the ice making process. In this regard, at the start of an ice making process, relatively warm water may be dispensed into ice mold 204, thereby raising the humidity within ice making chamber 200. By opening damper 220 at the start of the ice making process, the humidity within ice making chamber 200 may be quickly reduced, thereby preventing the formation of frost. In addition, the flow of cool air 214 may reduce the temperature within ice making chamber 200 to begin freezing the ice 166 within ice mold 204. After the excessive humidity has been evacuated, it may be desirable to close damper 220, e.g., to allow the temperature to increase and improve the ice formation process. By operating damper 220 as described, issues with excessive humidity (e.g., frost formation) may be reduced while the quality of ice cubes produced may improve.

According to still other embodiments, refrigerator appliance 100 may include a heating assembly 240 that is in thermal communication with second icebox 162 for selectively heating second icebox 162. For example, heating assembly 240 may include a plurality of resistive heaters 242 that are positioned within second icebox 162 and freezer door 126. Heating assembly 240 may be selectively operated in order to melt any collected frost, to regulate the temperature within second icebox 162, etc.

Refrigerator appliance 100 may further include one or more temperature sensors 250 that are generally positioned for monitoring the temperatures of freezer chamber 122, second icebox 162, ice making chamber 200, evaporator temperatures, etc. Specifically, according to the illustrated embodiment, temperature sensor 250 may be positioned within second icebox 162 for monitoring temperatures therein. Controller 134 may be in operative communication with temperature sensor 250 to measure temperatures, detect the presence of frost, etc. According to an example embodiment, one or more resistive heaters 242 may be positioned directly on damper 220, e.g., to melt frost form thereon and to prevent damper 220 from locking up or binding. According to an example embodiment, controller 134 may be configured to turn on heating assembly 240 when damper 220 is in the closed position and an icebox temperature falls below a predetermined threshold.

As used herein, "temperature sensor" or the equivalent is intended to refer to any suitable type of temperature measuring system or device positioned at any suitable location for measuring the desired temperature. Thus, for example, temperature sensor 250 may each be any suitable type of temperature sensor, such as a thermistor, a thermocouple, a resistance temperature detector, a semiconductor-based integrated circuit temperature sensor, etc. In addition, temperature sensor 250 may be positioned at any suitable location and may output a signal, such as a voltage, to a controller that is proportional to and/or indicative of the temperature being measured. Although exemplary positioning of temperature sensors is described herein, it should be appreciated that refrigerator appliance 100 may include any other suitable number, type, and position of temperature, humidity, and/or other sensors according to alternative embodiments.

According to still other embodiments, controller 134 may be configured to determine that a dehumidification cycle is needed and periodically open damper 220 for a predetermined amount of time to purge humid air from within ice making chamber 200. For example, controller 134 may be in operative communication with a humidity sensor 252 for determining when the humidity within ice making chamber 200 exceeds a predetermined threshold humidity. By contrast, determining that a dehumidification cycle is needed may be based on the elapsed time since commencing an ice making process. For example, damper 220 may be regulated based on how recently water has been dispensed into ice mold 204. It should be appreciated that other means for determining that a dehumidification cycle is needed may be used while remaining within the scope of the present subject matter.

According to alternative embodiments, determining that a dehumidification cycle is needed may be based on elapsed time since a prior dehumidification cycle, an indication of frost buildup, or a number of icemaking cycles performed since the prior dehumidification cycle. According to still other embodiments, determining that the dehumidification cycle is needed may be based on a measured icebox temperature or humidity, a measured freezer temperature or humidity, and/or a measured freezer evaporator temperature. Similarly, controller 134 may be programmed to determine when frost has formed and may operate heating assembly 240 accordingly to adjust the temperature within second icebox 162. Controller 134 may also use heating assembly 240 to regulate temperature to the desired ice formation temperature.

As explained herein, aspects of the present subject matter are generally directed to a frost removal damper for an ice maker. To make better quality ice cubes, the temperature above an ice mold body should be maintained higher than normal freezer compartment temperature but less than freezing temperature (15-20° F.). When the ice maker needs warmer temperature on top of ice mold body, the ice maker may preferably be closed above the ice mold body to hold warmer air efficiently. At the same time, an air inlet and outlet area are provided under the ice mold body to allow cold air to come into the icebox. For defrosting and better air circulation, the ice maker may include a damper (e.g., a shutter), and when the ice maker does not need warmer temperatures, the damper may be opened. This ice maker may be used to produce good quality "craft ice" (e.g., cocktail ice) which is bigger than normal ice cubes. The ice maker may include a twist tray system (e.g., a motor/gear/control box, an ice tray, a thermistor, etc.) for good quality and a damper assembly (e.g., a damper, a motor/gear, a damper heater, etc.). The damper may be open for a quick ice making mode and for the first several hours of ice formation, and the damper may be closed for the last portion of ice formation. The damper heater may be turned on only when the damper is closed and icebox temperature is cold.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, comprising:

a cabinet defining a chilled chamber;

a door being rotatably mounted to the cabinet to provide selective access to the chilled chamber;

an icebox mounted on the door and defining an ice making chamber and an icebox opening to the ice making chamber;

a damper mounted over the icebox opening and being movable between an open position to permit a flow of air through the icebox opening and a closed position to prevent the flow of air through the icebox opening; and a controller configured to open the damper during a first portion of an ice making process and close the damper during a second portion of the ice making process.

2. The refrigerator appliance of claim 1, further comprising:

an ice storage bin positioned below the icebox for storing ice, wherein an intake slot is defined between the icebox and the ice storage bin.

3. The refrigerator appliance of claim 1, wherein the icebox opening is defined in a top wall of the icebox.

4. The refrigerator appliance of claim 1, further comprising:

a drive motor operably coupled to the damper; and a controller in operative communication with the drive motor for selectively pivoting the damper between the open position and the closed position.

5. The refrigerator appliance of claim 1, further comprising a controller configured to:

determine that a dehumidification cycle is needed; and open the damper for a predetermined amount of time to purge humid air from the ice making chamber.

6. The refrigerator appliance of claim 5, wherein the determination that the dehumidification cycle is needed is based on an elapsed time since commencing an ice making process.

7. The refrigerator appliance of claim 1, further comprising:

a heating assembly in thermal communication with the icebox for selectively heating the icebox.

8. The refrigerator appliance of claim 7, wherein the heating assembly comprises a resistive heater.

9. The refrigerator appliance of claim 7, further comprising a controller configured to:

turn on the heating assembly when the damper is in the closed position and an icebox temperature falls below a predetermined threshold.

10. The refrigerator appliance of claim 1, further comprising:

a temperature sensor positioned in thermal communication with the icebox.

11. The refrigerator appliance of claim 1, further comprising:

a craft icemaker positioned within the icebox.

12. The refrigerator appliance of claim 1, wherein the chilled chamber is a freezer compartment of the refrigerator appliance.

13. The refrigerator appliance of claim 1, wherein the refrigerator appliance is a side-by-side refrigerator appliance.

14. An ice making assembly mounted on a door of a refrigerator appliance, the ice making assembly comprising:

an icebox mounted on the door and defining an ice making chamber and an icebox opening to the ice making chamber;

an ice storage bin positioned below the icebox for storing ice, wherein an intake slot is defined between the icebox and the ice storage bin;

a damper mounted over the icebox opening and being movable between an open position to permit a flow of air through the icebox opening and a closed position to prevent the flow of air through the icebox opening;

a drive motor operably coupled to the damper; and a controller in operative communication with the drive motor for selectively pivoting the damper between the open position and the closed position, wherein the controller is configured to:

determine that a dehumidification cycle is needed; and open the damper for a predetermined amount of time to purge humid air from the ice making chamber.

15. The ice making assembly of claim 14, wherein the icebox opening is defined in a top wall of the icebox.

16. The ice making assembly of claim 14, wherein the controller is configured to open the damper during a first portion of an ice making process and close the damper during a second portion of the ice making process.

17. The ice making assembly of claim 14, wherein the determination that the dehumidification cycle is needed is based on an elapsed time since commencing an ice making process.

18. The ice making assembly of claim 14, further comprising:

a heating assembly in thermal communication with the icebox for selectively heating the icebox, wherein the controller is configured to turn on the heating assembly when the damper is in the closed position and an icebox temperature falls below a predetermined threshold.

19. A refrigerator appliance defining a vertical direction, a lateral direction, and a transverse direction, comprising:

a cabinet defining a chilled chamber;

a door being rotatably mounted to the cabinet to provide selective access to the chilled chamber;

an icebox mounted on the door and defining an ice making chamber and an icebox opening to the ice making chamber;

a damper mounted over the icebox opening and being movable between an open position to permit a flow of air through the icebox opening and a closed position to prevent the flow of air through the icebox opening;

a heating assembly in thermal communication with the icebox for selectively heating the icebox; and a controller configured to turn on the heating assembly when the damper is in the closed position and an icebox temperature falls below a predetermined threshold.

20. The refrigerator appliance of claim 19, further comprising:

an ice storage bin positioned below the icebox for storing ice, wherein an intake slot is defined between the icebox and the ice storage bin.

* * * * *